US009108400B1

(12) United States Patent
Cornell et al.

(10) Patent No.: US 9,108,400 B1
(45) Date of Patent: Aug. 18, 2015

(54) METHOD FOR PREVENTING FLUTES ON A PRINT SIDE

(71) Applicants: David James Cornell, Scottsville, NY (US); Christopher M. Muir, Rochester, NY (US)

(72) Inventors: David James Cornell, Scottsville, NY (US); Christopher M. Muir, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/246,202

(22) Filed: Apr. 7, 2014

(51) Int. Cl.

| | |
|---|---|
| ***B41J 2/015*** | (2006.01) |
| ***B41F 23/00*** | (2006.01) |
| ***B41J 2/21*** | (2006.01) |
| ***B41J 11/00*** | (2006.01) |

(52) U.S. Cl.
CPC ..... *B41F 23/00* (2013.01); *B41J 2/2114* (2013.01); *B41J 11/0015* (2013.01)

(58) Field of Classification Search
CPC .... B41J 2/2114; B41J 2/2117; B41J 11/0015; B41J 2/125; B41J 2/2135
USPC ..... 347/9, 20, 21, 40, 42, 98
See application file for complete search history.

(56) References Cited

U.S. PATENT DOCUMENTS 8,079,694 B2 12/2011 Steed et al.
8,789,916 B2 * 7/2014 Mitsuzawa ..... 347/21

* cited by examiner

*Primary Examiner* — An Do
(74) *Attorney, Agent, or Firm* — Peyton C. Watkins

(57) ABSTRACT

A method for printing an image on a substrate, the method including providing a plurality of rollers for moving a substrate on which the images are printed; depositing a plurality of different colored inks on a print side of the substrate which forms the image; depositing a clear liquid on the print side of the substrate in a linear, spaced apart pattern adjacent an edge of the image for forming clear liquid ribs; wherein the clear liquid ribs extend away from the image, and the clear liquid is devoid in at least at a plurality of portions between the clear liquid ribs.

17 Claims, 12 Drawing Sheets

METHOD FOR PREVENTING FLUTES ON A PRINT SIDE

CROSS-REFERENCE TO RELATED APPLICATIONS

Reference is made to commonly-assigned, co-pending U.S. patent application Ser. No. 14/246,227 filed concurrently herewith, entitled "METHOD FOR PREVENTING FLUTES ON A NON-PRINT SIDE" by Christopher J. Muir, et al., the disclosure of which is incorporated herein.

FIELD OF THE INVENTION

The present invention generally relates to preventing flutes in digital printing and, more particularly, to depositing a plurality of clear liquid patterns on the substrate for preventing flutes.

BACKGROUND OF THE INVENTION

In a digitally controlled inkjet printing system, a receiver media (also referred to as a print medium) is conveyed past a series of components. The receiver media can be a cut sheet of receiver media or a continuous web of receiver media. A web or cut sheet transport system physically moves the receiver media through the printing system. As the receiver media moves through the printing system, liquid (e.g., ink) is applied to the receiver media by one or more printheads through a process commonly referred to as jetting of the liquid. The jetting of liquid onto the receiver media introduces significant moisture content to the receiver media, particularly when the system is used to print multiple colors on a receiver media. Due to the added moisture content, an absorbent receiver media expands and contracts in a non-isotropic manner, often with significant hysteresis. The continual change of dimensional characteristics of the receiver media can adversely affect image quality. Although drying is used to remove moisture from the receiver media, drying can also cause changes in the dimensional characteristics of the receiver media that can also adversely affect image quality.

FIG. 1 illustrates a type of distortion of a receiver media 3 that can occur during an inkjet printing process. As the receiver media 3 absorbs the water-based inks applied to it, the receiver media 3 tends to expand. The receiver media 3 is advanced through the system in an in-track direction 4. The perpendicular direction, within the plane of the un-deformed receiver media 3, is commonly referred to as the cross-track direction 7. Typically, as the receiver media 3 expands in the cross-track direction 7, contact between the receiver media 3 and the contact surface 8 of the rollers 2 (or other web guiding components) in the inkjet printing system can produce sufficient friction such that the receiver media 3 is not free to slide in the cross-track direction 7. This can result in localized buckling of the receiver media 3 away from the rollers 2 to create lengthwise flutes 5, also called ripples or wrinkles, in the receiver media 3. Wrinkling of the receiver media 3 during the printing process can lead to permanent creases in the receiver media 3 which adversely affects image quality.

U.S. Pat. No. 8,079,694 to Daly et al., entitled "Clear Fluid Patterning on Paper Media," discloses depositing clear toner surrounding the entirety of the image or images, and the clear toner covers all or, in one case, most of the page on which the image is printed. "The pattern of clear fluid is defined by a maximum width that is generally equal to the maximum width of the image to be formed," (Abstract) and the clear fluid must "contact" the image it surrounds.

While U.S. Pat. No. 8,079,694 is satisfactory, it includes drawbacks. First, the present invention overcomes the limited teachings of U.S. Pat. No. 8,079,694 in which the maximum width of a pattern must be equal to the image to be formed. Second, this method is costly since clear fluid is deposited in large quantities on the page of interest. Costly is obviously a driver in deciding whether a method is suitable for commercial use. Therefore, a need exists for a means to prevent the formation of receiver media wrinkles as a receiver media contacts web-guiding structures in a digital printing system which is cost effective in the use of clear fluid and overcomes technical limitations of the prior art.

As will be described below, the present invention solves the shortcomings of U.S. Pat. No. 8,079,694.

SUMMARY OF THE INVENTION

The present invention is directed to overcoming one or more of the problems set forth above. Briefly summarized, according to one aspect of the invention, the invention resides in a method for printing an image on a substrate, the method comprising the steps of providing a plurality of rollers for moving a substrate on which the images are printed; depositing a plurality of different colored inks on a print side of the substrate which forms the image; depositing a clear liquid on the print side of the substrate in a linear, spaced apart pattern adjacent an edge of the image for forming clear liquid ribs; wherein the clear liquid ribs extend away from the image, and the clear liquid is devoid in at least a plurality of portions between the clear liquid ribs.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

As described herein, the exemplary embodiments of the present invention provide receiver media guiding components useful for guiding the receiver media in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other substrates in which inkjet is appropriate. For example, vinyl sheets, plastic sheets, textiles, paperboard and corrugated cardboard in addition to paper can comprise the substrate. Additionally, although the term inkjet is often used to describe the printing process, the term jetting is also appropriate wherever ink or other liquids is applied in a consistent, metered fashion, particularly if the desired result is a thin layer or coating.

Figure 1:
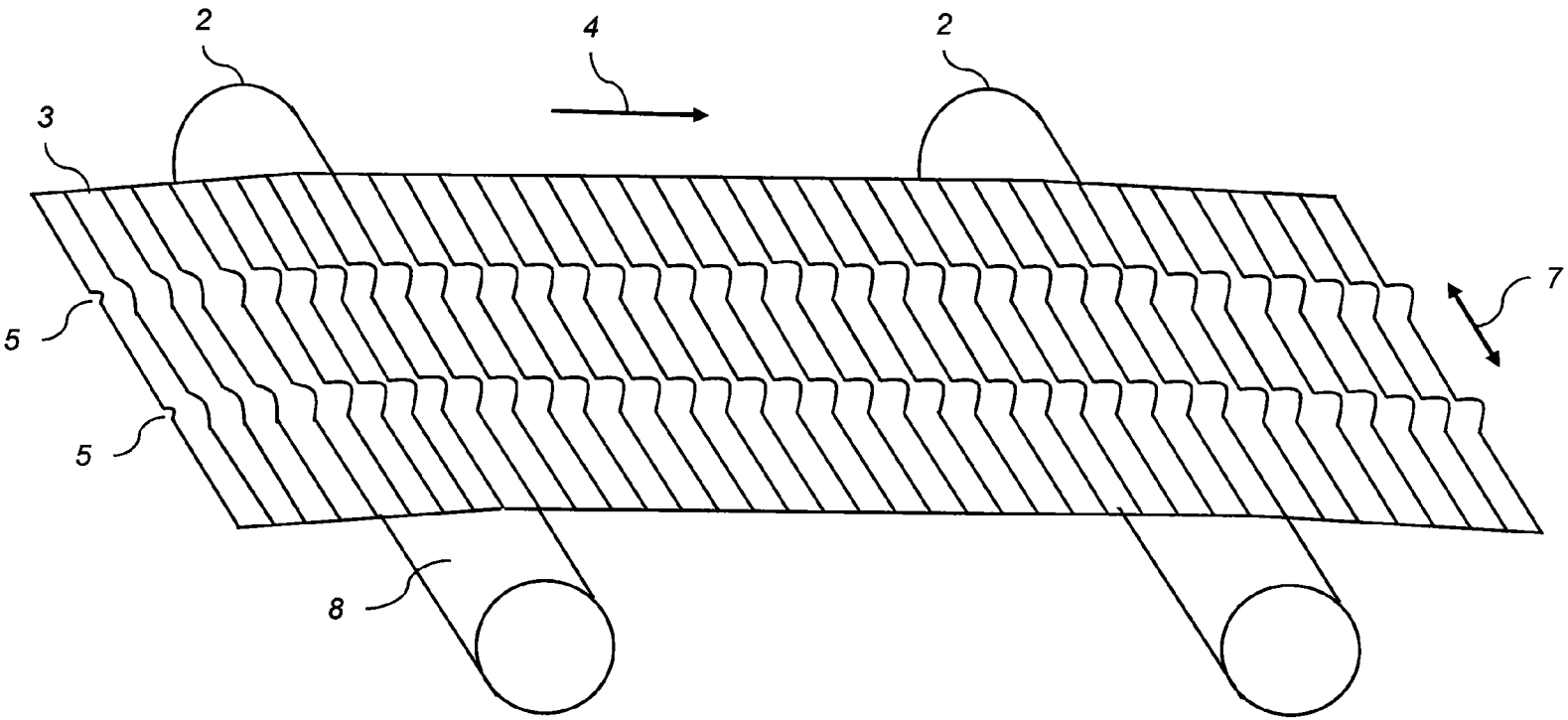
FIG. 1 (Prior Art)
FIG. 1 is a perspective view of a prior art substrate in a digital printing system.
Figure 2A:
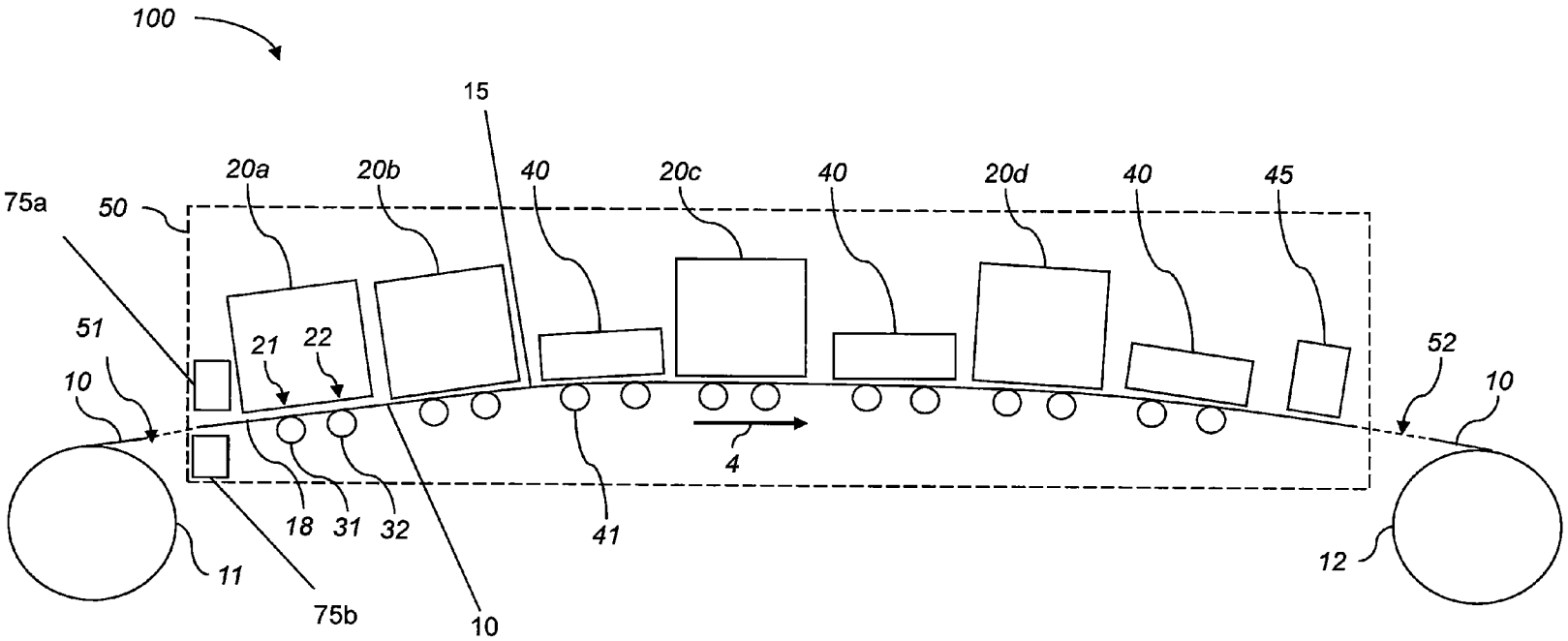
FIG. 2A is a simplified side view of a digital printing system of the present invention.

Referring to FIG. 2A, there is shown a simplified side view of a portion of a digital printing system 100 for printing on a first side 15 of a continuous web of substrate 10 with a printing module 50 having printheads 75*a*, 20*a*, 20*b*, 20*c*, 20*d*, dryers 40, and a quality control sensor 45. In this exemplary system, the first printhead 75*a* jets water or clear ink, the second printhead 20*a* jets cyan ink, the third printhead 20*b* jets magenta ink, the fourth printhead 20*c* jets yellow ink, and the fifth printhead 20*d* jets black ink. The printing module also includes a printhead 75*b* for printing on a second side 18 (non-print side), if desired, with water or clear ink. As will be described in detail herein below, the printheads 75*a* and 75*b* deposits the water or clear ink in a pattern for permitting cross-track stretching to occur in a more uniform manner. The printheads 75*a* and 75*b* may be used in combination or either may print singularly without printing by the other.

Below each printhead 20*a*, 20*b*, 20*c*, 20*d* is a media guide assembly including print line rollers 31 and 32 that guide the continuous web of substrate 10 past a first print line 21 and a second print line 22 as the substrate 10 is advanced along a media path in the in-track direction 4. Below each dryer 40 is at least one dryer roller 41 for controlling the position of the web of substrate 10 near the dryers 40.

Substrate 10 originates from a source roll 11 of unprinted substrate 10, and printed substrate 10 is wound onto a take-up roll 12. Other details of the printing module 50 and the digital printing system 100 are not shown in FIG. 2 for simplicity. For example, to the left of printing module 50, a first zone 51 (illustrated as a dashed line region in substrate 10) can include a slack loop, a web tensioning system, an edge guide and other elements that are not shown. To the right of printing module 50, a second print zone 52 (illustrated as a dashed line region in substrate 10) can include a turnover mechanism and a second printing module similar to printing module 50 for printing on a second side of the substrate 10.

Figure 2B:
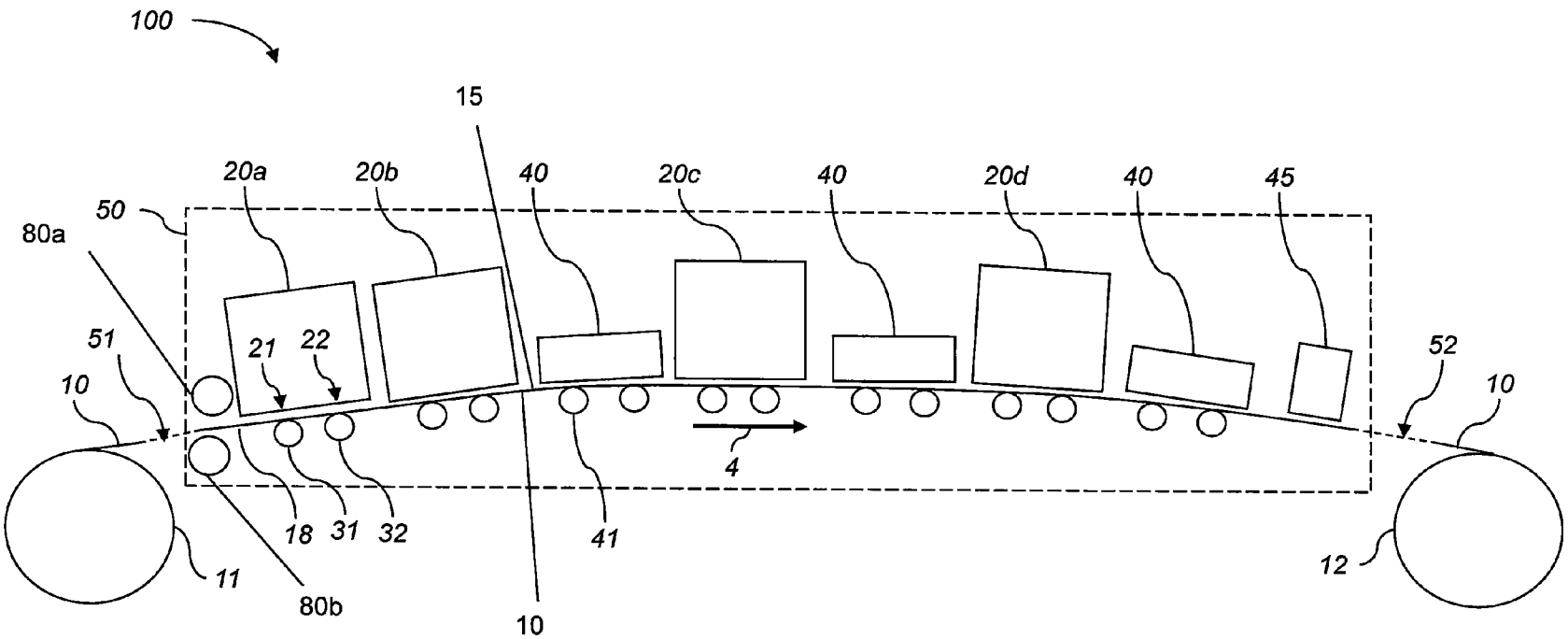
FIG. 2B is a simplified side view of a digital printing system of the present invention using gravure rollers in lieu of printhead for the water or clear ink.

Referring to FIG. 2B, in another embodiment, gravure rollers 80*a* and 80*b* may be used in lieu of the printheads 75*a* and 75*b* if desired. All the other components are the same as in FIG. 2A.

Figure 3A:
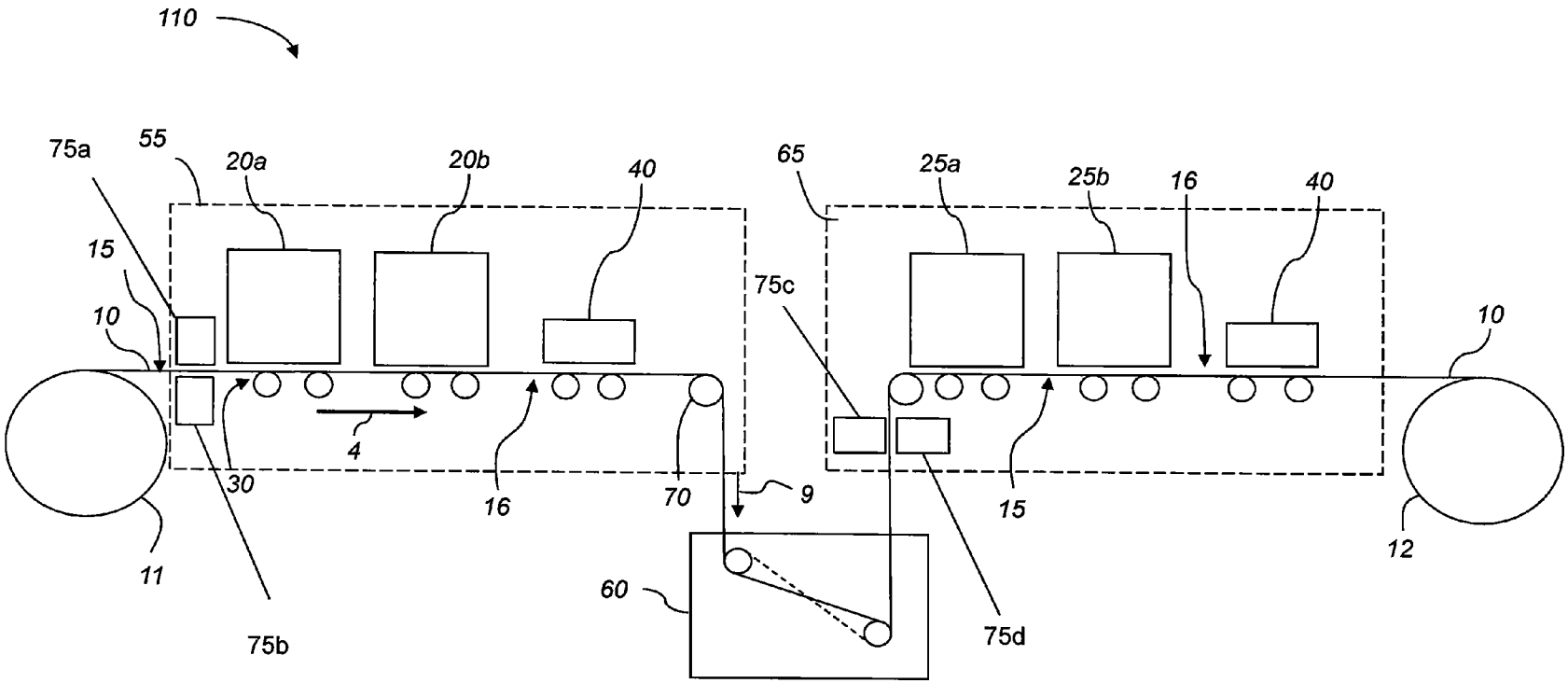
FIG. 3A is a simplified side view of a digital printing system inclusive of a turnover mechanism.

Referring to FIG. 3A, there is shown a simplified side view of a portion of a printing system 110 for printing on both a first side 15 and a second side 16 of a continuous web of substrate 10. Printing system 110 includes a first printing module 55, for printing on a first side 15 of the continuous web, having four printheads 75*a*, 75*b*, 20*a*, 20*b* and a dryer 40; a turnover mechanism 60; and a second printing module 65, for printing colored inks on the second side of the continuous web, having four printheads 75*c*, 75*d*, 25*a* and 25*b* and a dryer 40. It is instructive to note that the printheads 75*a*, 75*b*, 75*c* and 75*d* also deposit water or clear ink for permitting cross-track stretching to occur in a more uniform manner. The printheads 75*a* and 75*d* print on the first side 15 and the printheads 75*b* and 75*c* print on the second side 16. In the case of printhead 75*d*, the clear ribs 130 (see FIGS. 4-8) will be printed over the printed image 120 (see FIGS. 4-8).

A web-guiding system 30 guides the web of substrate 10 from upstream to downstream along a transport path in an in-track direction 4 past through the first printing module 55 and the second printing module 65. The web-guiding system 30 includes rollers aligned with the print lines of the printheads 20*a*, 20*b*, 25*a*, and 25*b*. These rollers 2 maintain the substrate 10 at a fixed spacing from the printing modules to ensure a consistent time of flight for the print drops emitted by the printheads 20*a*, 20*b*, 25, 25*b*. The web-guiding system 30 also includes a web-guiding structure 70, which can be a roller for example, positioned near the exit of first printing module 55 for redirecting a direction of travel of the web of substrate 10 along exit direction 9 in order to guide the web of substrate 10 toward the turnover mechanism 60. The movement of the receiver media 3 of the guiding rollers 2 of the web guiding system 30 also maintains the cross-track position of the continuous web provided there is sufficient traction between the continuous web and the guiding rollers 2.

It is not uncommon for a web-guiding system 30 to include a web-guiding structure 70 that provides a large angular change in the direction of travel of the web of the substrate 10. Such large angular changes may be required by geometric constraints on the overall dimensions of the web-guiding system 30 or the need to align the web of substrate 10 with a downstream portion of the web-guiding system 30. For example, web-guiding structure 70, which is positioned near the exit of first printing module 55, redirects the direction of travel of the web of substrate 10 by about 90° into exit direction 9 in order to guide web of substrate 10 toward the turnover mechanism 60.

When the substrate 10 is a hygroexpansive material such as cellulose based paper, and at least portions of the substrate 10 are moistened such as by inkjet printing, the receiver media 3 can be prone to wrinkling when wrapped at high wrap angles around a roller 2. A similar tendency to wrinkle exists at high wrap angle rollers when a very thin receiver media 3, such as plastic films of polyethylene and poly (ethylene terephthalate), is being transported along the transport path by the web-guiding system 30, as such substrate 10 lacks the compressive strength to flatten the ripples produced in the substrate 10 by the variations in the in-track and cross-track tension.

Figure 3B:
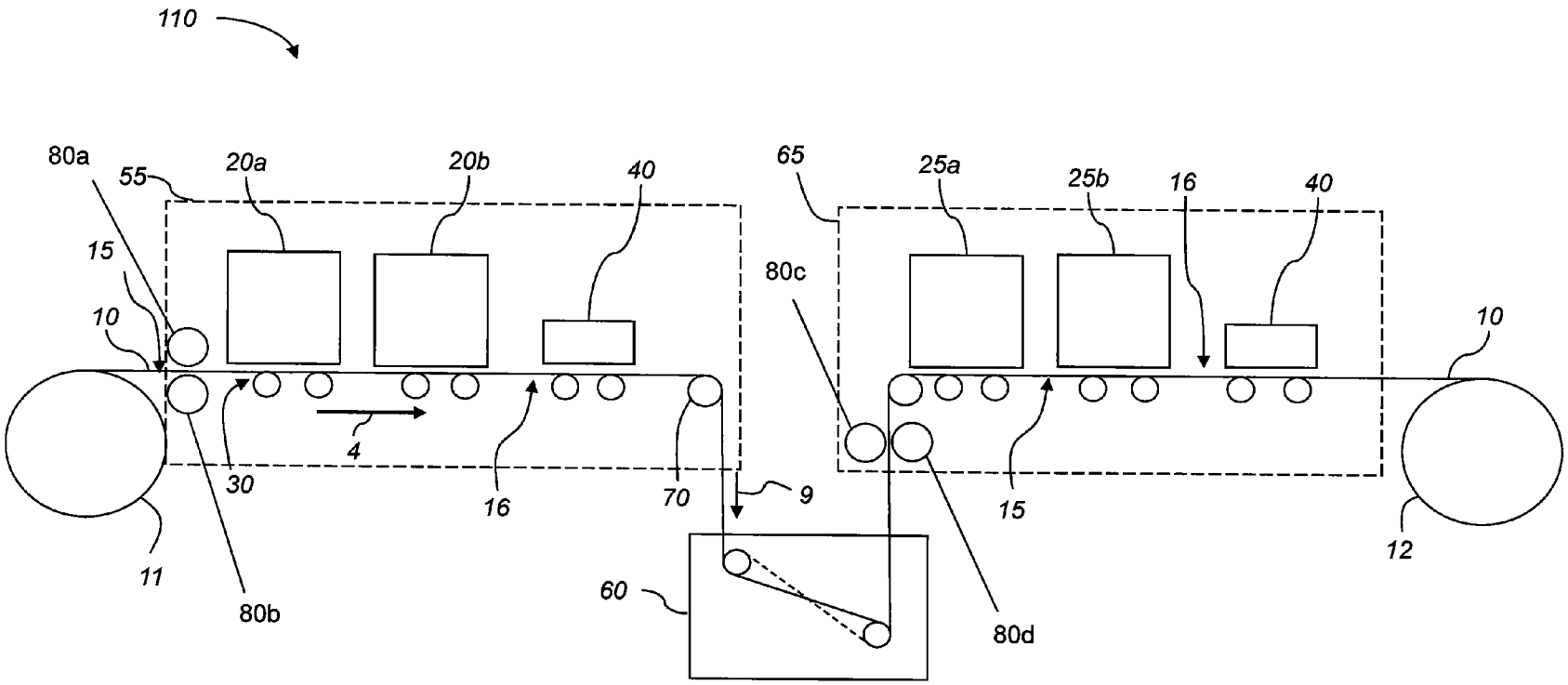
FIG. 3B is a simplified side view of a digital printing system inclusive of a turnover mechanism using gravure rollers in lieu of printheads.

Referring to FIG. 3B, in another embodiment, gravure rollers 80*a*, 80*b*, 80*c* and 80*d* may be used in lieu of the printheads 75*a*, 75*b*, 75*c* and 75*d* if desired. All the other components are the same as in FIG. 3A.

Figure 4:
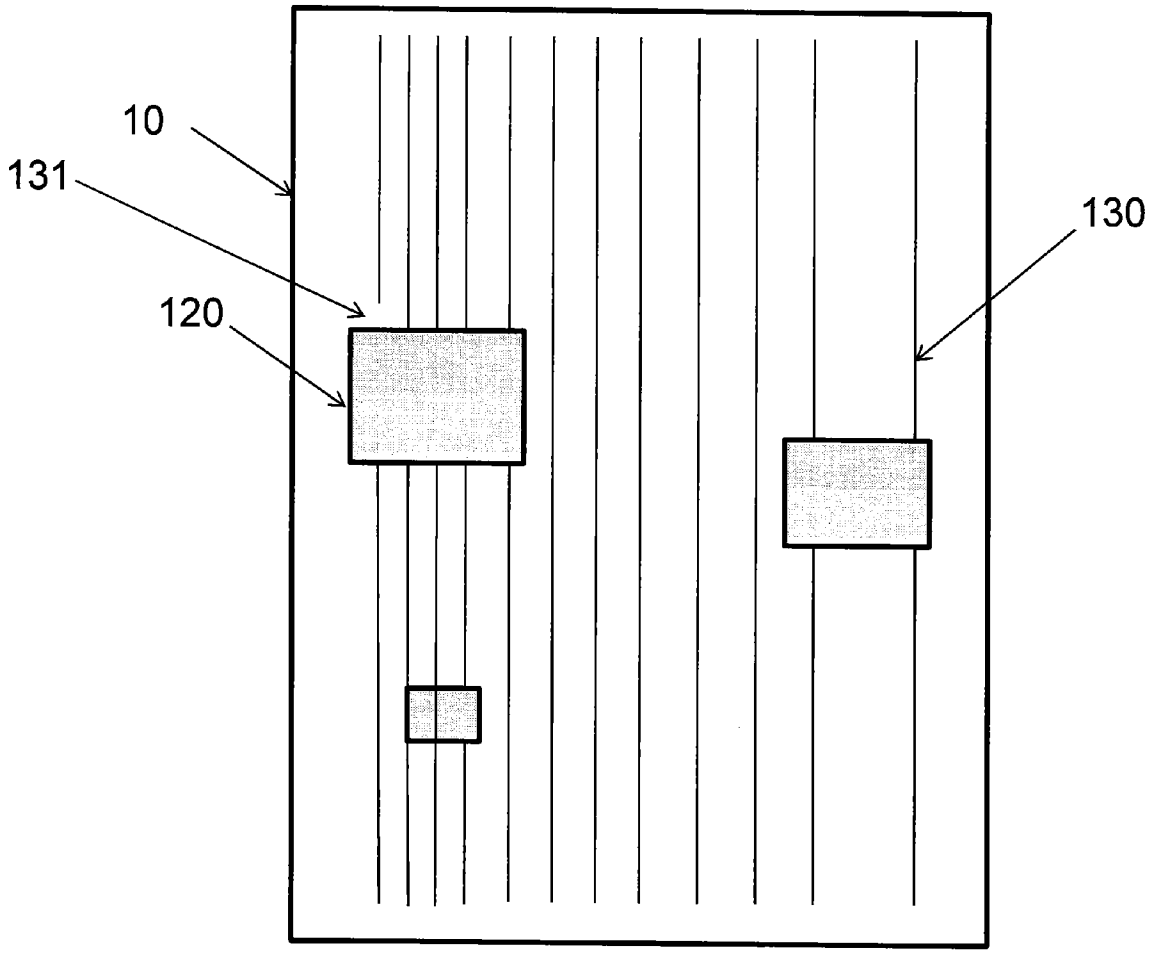
FIG. 4 is a top view of a substrate having images and clear ribs of the present invention.

Referring to FIG. 4, there is shown a top view of the substrate 10 having a plurality of image 120 printed thereon. The present invention deposits a plurality of spaced apart, linear clear ribs 130 formed of the clear liquid, such as water or clear ink, and arranged in parallel, equally spaced, continuous straight lines in the in-track direction adjacent the images 120. The maximum width of each clear rib 130 is smaller than the image to which it is adjacent. The clear ribs 130 are adjacent the image 120 which means that the clear ribs 130 may abut a plurality of portions of the image or be in close proximity, but not touching, leaving a small space 131 between the image 120 and clear rib 130. It is understood that the clear liquid is devoid at a plurality of portions between the clear liquid ribs. The option to have spacing 131 or not is a user preference and preferably all the clear ribs 130 are either abutting the image 120 or includes the spacing 131, although a combination of the two may be used. The clear ribs 130 permit cross-track stretching to occur in a more uniform manner regardless on the image size or location. The plurality of clear ribs 130 also breaks up the stiffness of non-printed areas to permit cross-track stretching and softens in-track transitions from the non-printed areas to heavy ink areas (images). As will be apparent, the present invention permits stretching but overcomes the cost inefficiencies of the prior art. The clear ribs 130 do not cover all or substantially all of the substrate 10 and is deposited more sparingly than the prior art so that the cost incurred as a result of depositing the clear ink is lowered. This has distinct advantages in commercialization especially considering the mass production of substrate 10 produced by digital printing systems 100. The embodiment of FIG. 4 is preferably done by printhead 75*a*.

Figure 5:
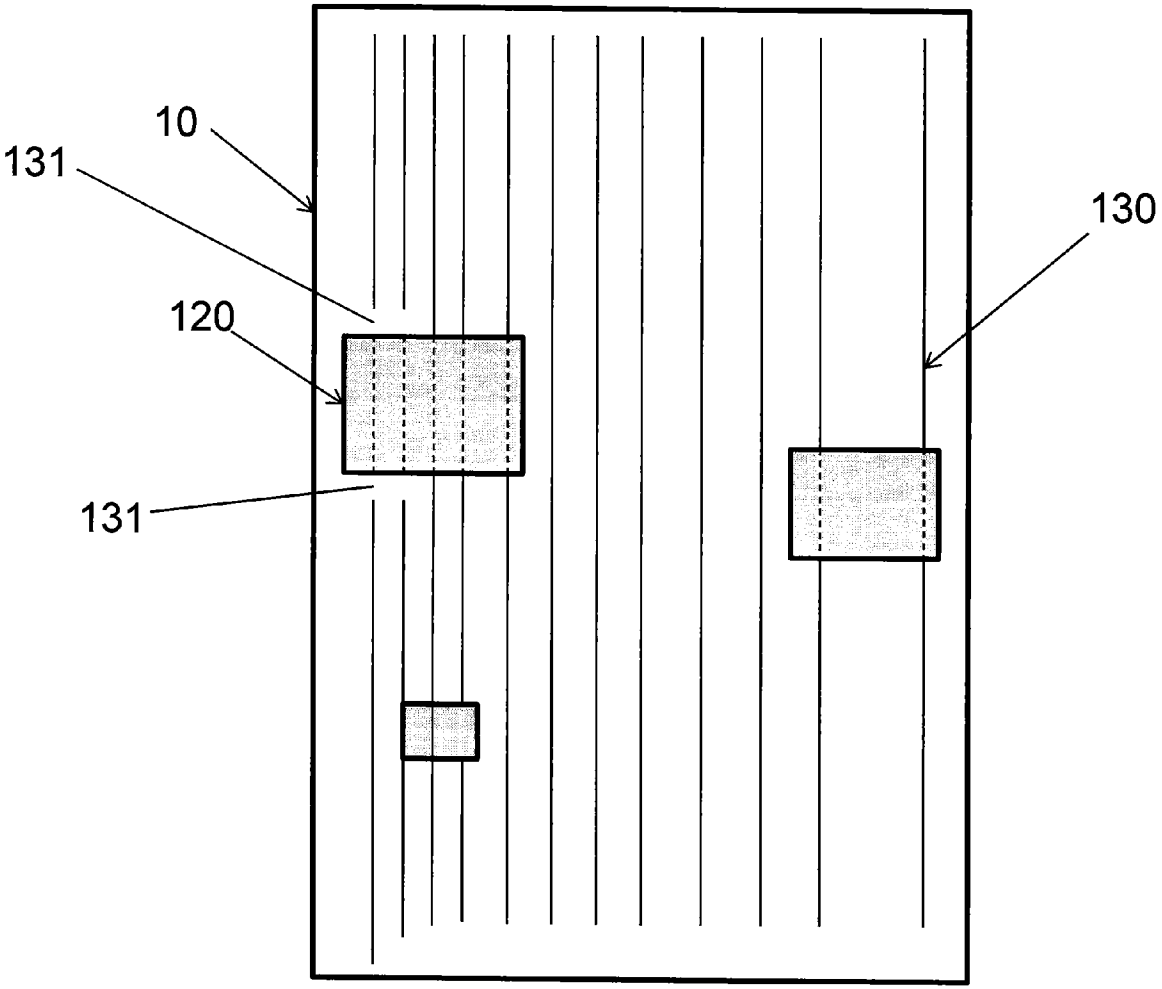
FIG. 5 is a top view of the substrate having images and the clear ribs in another configuration.

Referring to FIG. 5, there is shown another embodiment of the present invention. In this embodiment, the clear ribs 130 are the same as in FIG. 4 except that the plurality of clear ribs 130 are under the images 120 and also extend away from each image 120 in a continuous manner. It is instructive to note that the clear ribs 130 are deposited before the colored inks, which means the clear ribs 130 are extended under the images 120. The embodiment of FIG. 5 is preferable done by the printhead 75*a* if there is spacing 131 and either printhead 75*a* or gravure roller 80*a* if there is no spacing.

Figure 6:
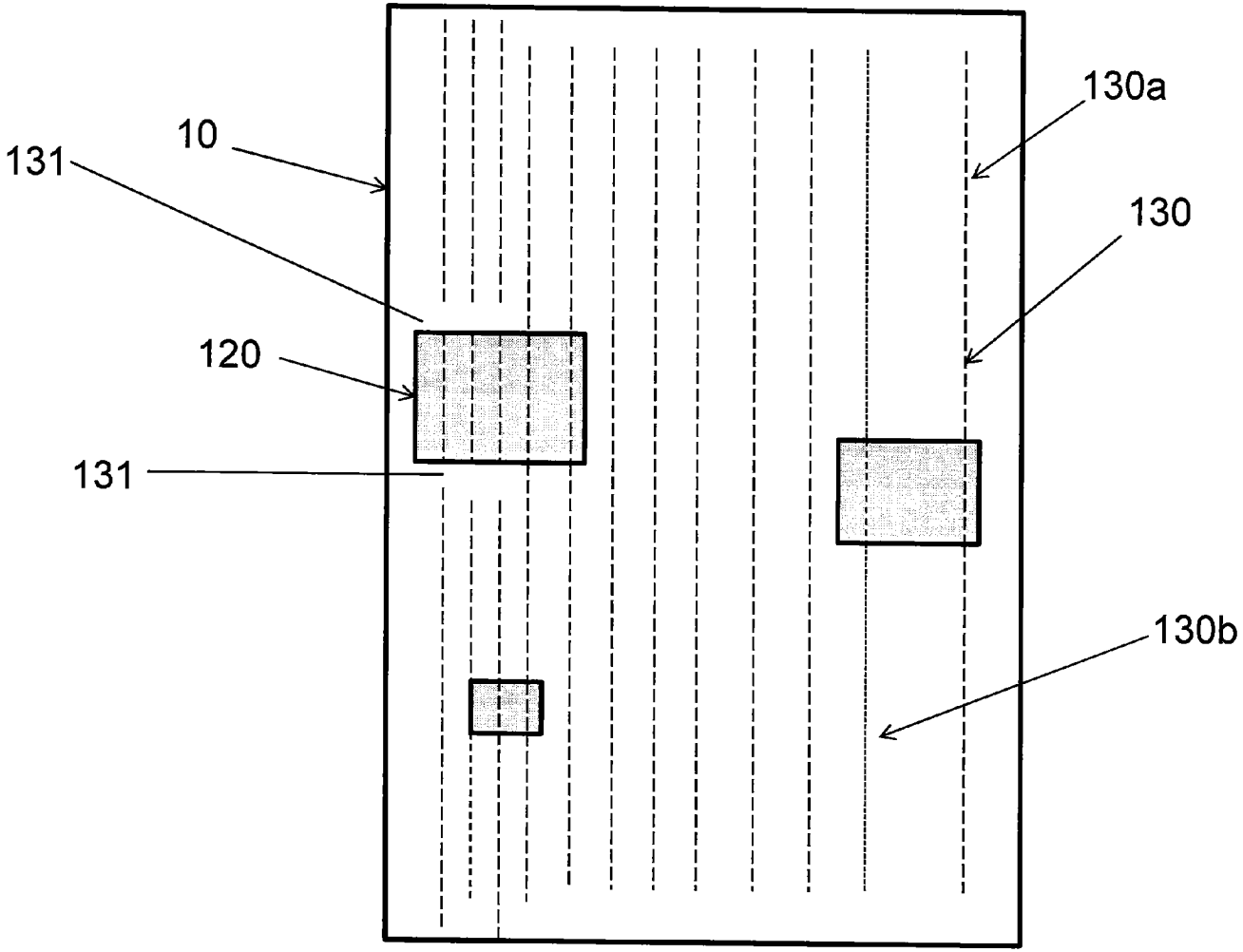
FIG. 6 is a top view of the substrate having images and the clear ribs in yet another configuration.

Referring to FIG. 6, the clear ribs 130 include all of the features of FIG. 5 except that the clear ribs 130 are formed in either a dashed 130*a* or dotted pattern 130*b*. The embodiment of FIG. 6 is preferable done by either the printhead 75*a* or the gravure roller 80*a*. The embodiment of FIG. 6 is preferable done by the printhead 75*a* if there is spacing 131 and either printhead 75*a* or gravure roller 80*a* if there is no spacing.

Figure 7:
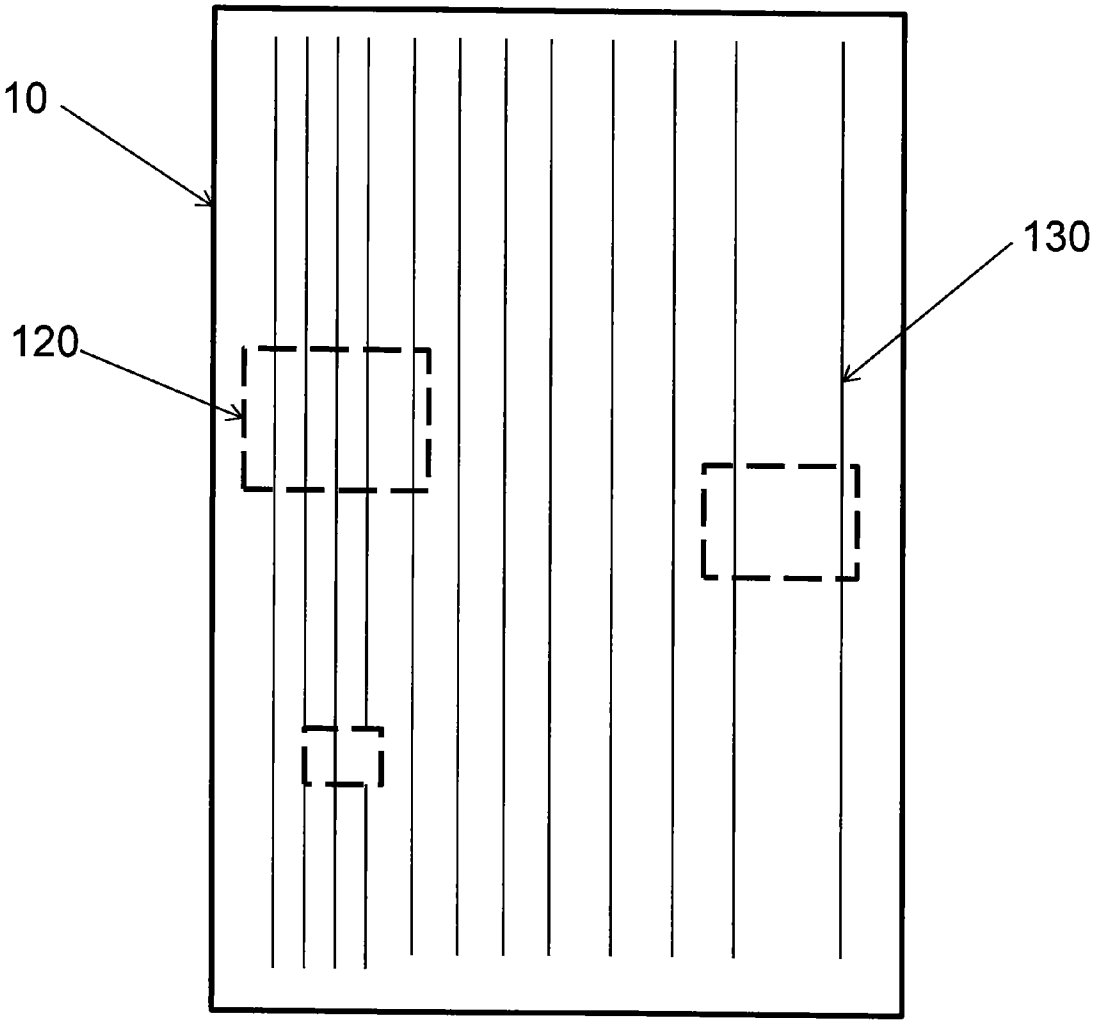
FIG. 7 is a view of the non-print side of the substrate having images on the print side and the clear ribs on the non-print side.

Referring to FIG. 7, the clear ribs 130 are deposited on the non-print side of the substrate 10 in a linear, equally spaced apart pattern in the in-track direction. The clear ribs 130 are a continuous line disposed both extending under the image on the non-print side and away from the images on the non-print side. This permits the substrate to have uniform substrate growth needed as a result of the properties if the deposited ink interacting with the substrate 10. The embodiment of FIG. 7 is preferably done by either the printhead 75*b* or the gravure roller 80*b*.

Figure 8:
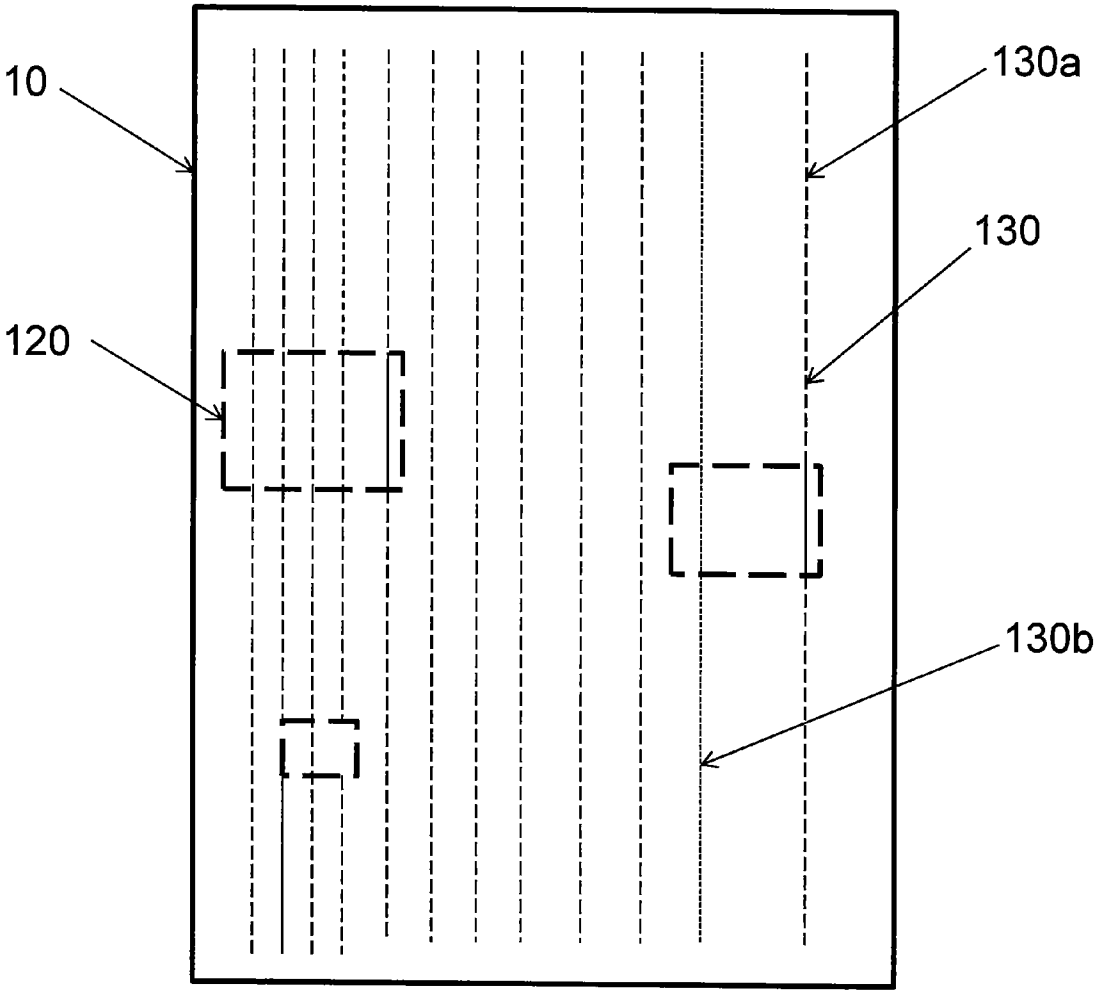
FIG. 8 is a view of the non-print side of the substrate having images on the print side and the clear ribs on the non-print side in yet another configuration.

Referring to FIG. 8, there is shown the clear ribs 130 as in FIG. 7 except that the lines are made of dashed 130*a* or dotted lines 130*b*. The embodiment of FIG. 8 is preferable done by either the printhead 75*b* or the gravure roller 80*b*.

Figure 9A:
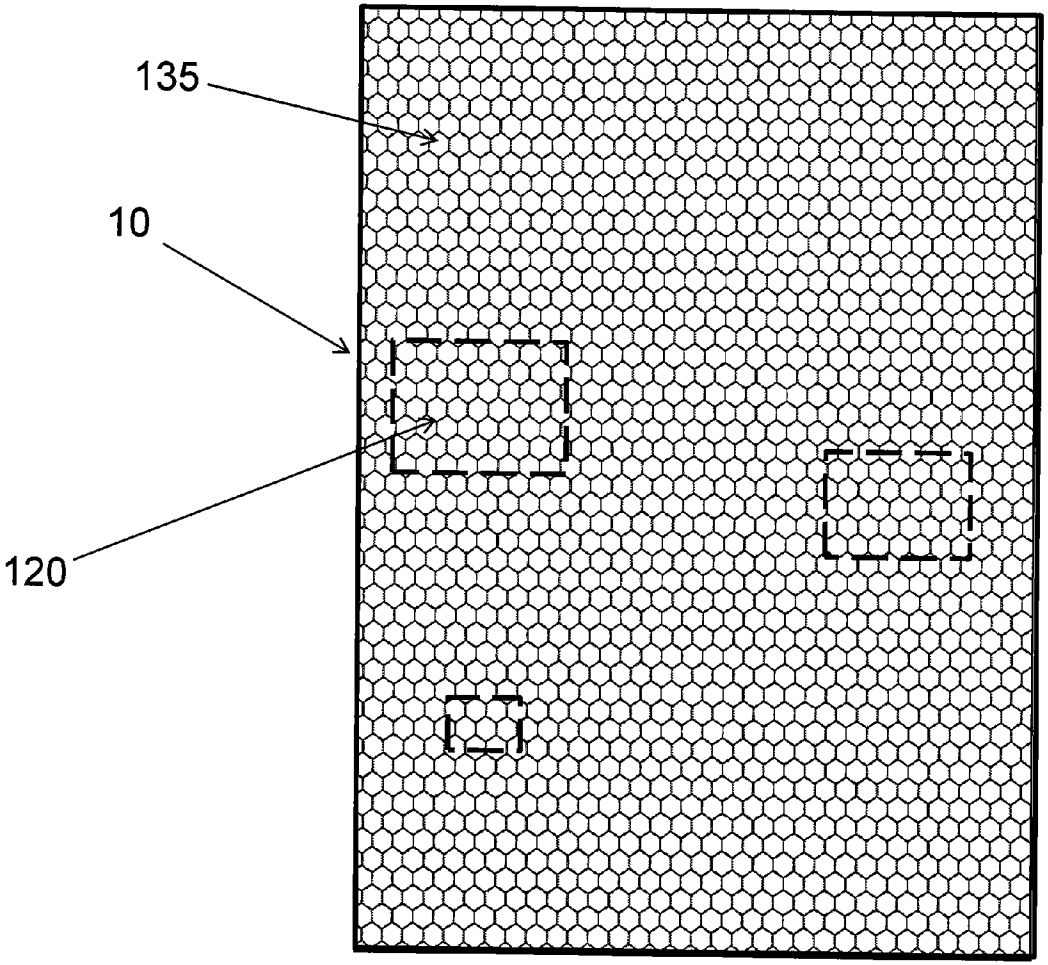
FIG. 9A is a view of the non-print side of the substrate having clear fluid hexagons.

Referring to FIG. 9A, there is shown yet another embodiment having a plurality of one or more shapes, each shape formed from clear liquid deposited on the non-print side 18 of the substrate 10 (deposited clear liquid) which deposited clear liquid has a width smaller than a width of an image to which it is adjacent. In this embodiment, the shape is a plurality of connected line segments formed in a hexagonal shape 135. As used herein, the shape of the present invention is not limited to the hexagonal shape 135 but may be any shape including, but not limited to, polygons, circles, scattered dots, polygons or polygons and circles formed of dots. These shapes are preferably symmetrical so that uniform growth occurs in both the in-track and cross-track directions. The embodiment of FIG. 9A is preferable done by either the printhead 75*b* or the gravure roller 80*b*.

Figure 9B:
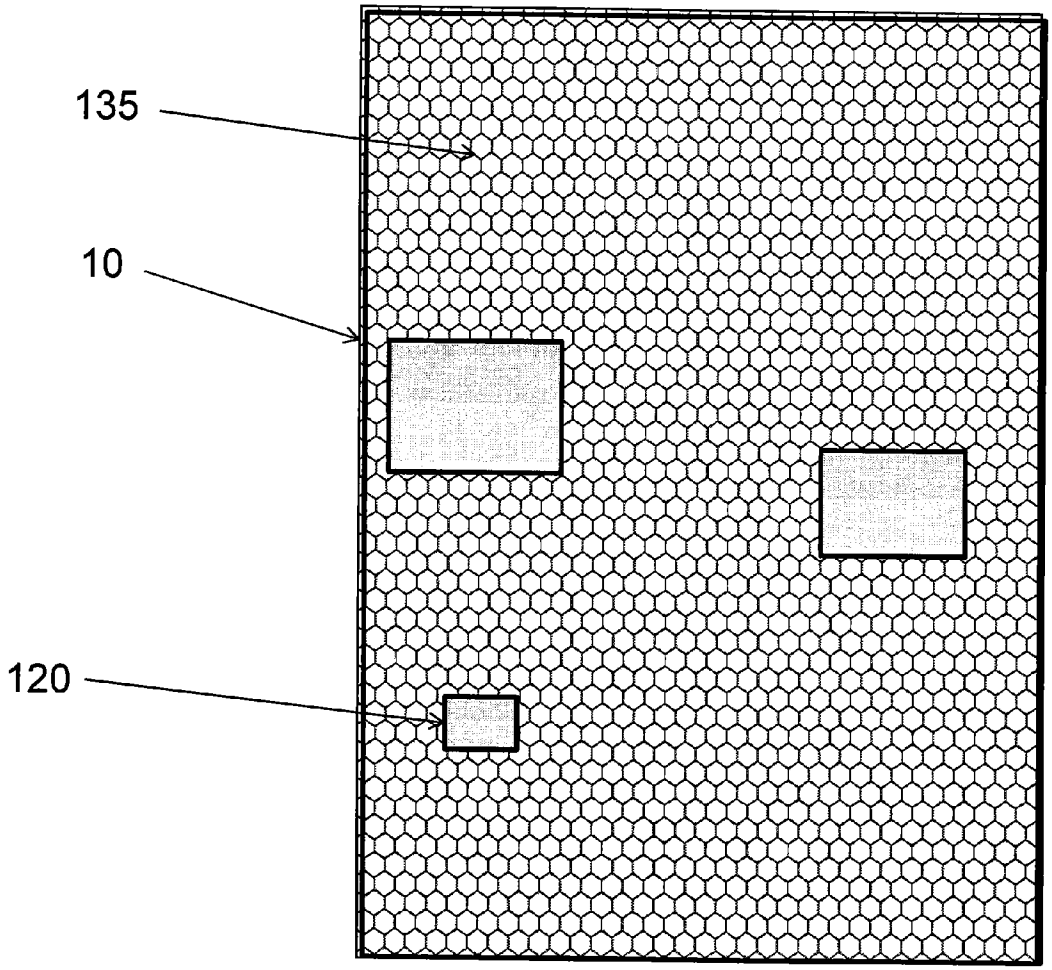
FIG. 9B is a view of the print side having clear fluid hexagons.

Referring to FIG. 9B, the clear fluid hexagonal shapes 135 are deposited on the first side 15 of the substrate 10. The embodiment of FIG. 9B is preferable done by either the printhead 75*a* or the gravure roller 80*a*.

The present invention has been described in detail with particular reference to certain preferred embodiments thereof, but it will be understood that variations and modifications can be effected within the spirit and scope of the invention.

PARTS LIST

2 rollers
3 receiver media
4 in-track direction
5 flutes
7 cross track direction
8 contact surface
9 exit direction
10 substrate
11 source roll
12 take up roll
15 first side
16 second side
20*a*-20*d* printheads
18 second side
21 first print line
22 second print line
25*a*, 25*b* printhead
30 web guiding system
31 print line rollers
32 print line rollers
40 dryers
41 dryer roller
45 control sensor
50 printing module
51 first zone
52 second print zone
55 first printing module
60 turnover mechanism
65 second printing module
70 web-guiding structure
75*a* printhead
75*b* printhead
75*c* printhead
75*d* printhead
80*a* gravure roller
80*b* gravure roller
80*c* gravure roller
80*d* gravure roller

100 digital printing system
110 printing system
120 images
130 clear ribs
130*a* dashed pattern
130*b* dotted pattern
131 space
135 hexagonal shape

The invention claimed is:

1. A method for printing an image on a substrate, the method comprising the steps of:

a) providing a plurality of rollers for moving a substrate on which the images are printed;

b) depositing a plurality of different colored inks on a print side of the substrate which forms the image;

c) depositing a clear liquid on the print side of the substrate in a pattern adjacent an edge of the image for forming a clear liquid pattern; wherein the clear liquid pattern is a plurality of linear ribs each having a width smaller than a width of the image to which the clear rib is adjacent and extends away from the image, or the clear liquid pattern is in a plurality of one or more shapes each shape formed from deposited clear liquid which has a width smaller than a width of an image to which it is adjacent.

2. The method as in claim 1, wherein the pattern of the clear ribs is a plurality of equally spaced apart straight lines extending from the edge of the image.

3. The method as in claim 2, wherein at least a portion of the spaced apart lines are parallel.

4. The method as in claim 2, wherein the spaced apart lines are disposed in along an in-track direction.

5. The method as in claim 2, wherein the spaced apart lines are continuous.

6. The method as in claim 2, wherein the spaced apart lines are dashed or dotted.

7. The method as in claim 1, wherein the clear liquid is clear water or clear ink.

8. The method as in claim 1, wherein the clear ribs includes a spacing between the clear rib and the image.

9. The method as in claim 1, wherein the plurality of clear liquid ribs extends in two directions from the edge so that the clear liquid extends both under portions of the image and away from the image.

10. The method as in claim 9, wherein the spaced apart lines are parallel.

11. The method as in claim 10, wherein at least a portion the clear liquid ribs is equally spaced straight line.

12. The method as in claim 9, wherein the spaced apart lines are disposed in along an in-track direction.

13. The method as in claim 9, wherein the spaced apart lines are continuous.

14. The method as in claim 9, wherein the spaced apart lines are dashed or dotted.

15. The method as in claim 9, wherein the clear liquid is clear water or clear ink.

16. The method as in claim 1, wherein the patterned shape is either polygons, circles, scattered dots, polygons or polygons and circles formed of dots.

17. The method as in claim 1, wherein the patterned shape is symmetrical.

* * * * *